United States Patent [19]

Andréasson

[11] Patent Number: 4,733,993

[45] Date of Patent: Mar. 29, 1988

[54] SUBSEA FOUNDATION ELEMENT AND APPLICATIONS THEREOF

[75] Inventor: Bo A. Andréasson, Gothenburg, Sweden

[73] Assignee: J & W Offshore AB, Sweden

[21] Appl. No.: 882,927

[22] Filed: Jun. 6, 1986

[30] Foreign Application Priority Data

Nov. 7, 1985 [WO] PCT Int'l Appl. .. PCT/SE85/00442

Nov. 9, 1984 [SE] Sweden ..... 8405613-4

[51] Int. Cl.[4] ..... E02D 23/02; B63B 21/27

[52] U.S. Cl. ..... 405/224; 114/296; 405/195; 405/204

[58] Field of Search ..... 405/224, 226, 207, 205, 405/204, 195, 206; 114/296

[56] References Cited

U.S. PATENT DOCUMENTS

| | | | |
|---|---|---|---|
| 1,960,080 | 5/1934 | Chapman | 405/226 X |
| 2,994,202 | 8/1961 | Knapp et al. | 405/224 |
| 3,263,641 | 8/1966 | Stimson | 405/224 X |
| 3,911,687 | 10/1975 | Mo | 405/225 |
| 3,919,957 | 11/1975 | Ray et al. | 405/224 X |
| 3,928,982 | 12/1975 | Lacroix | 405/224 |
| 4,126,008 | 11/1978 | Dixon | 405/207 |
| 4,318,641 | 3/1982 | Hogervorst | 405/224 |
| 4,344,721 | 8/1982 | Goldsmith | 405/224 |

FOREIGN PATENT DOCUMENTS

| | | | |
|---|---|---|---|
| 144379 | 5/1981 | Norway . | |
| 1433547 | 4/1976 | United Kingdom | 405/211 |
| 2097739 | 11/1982 | United Kingdom | 405/248 |

*Primary Examiner*—Dennis L. Taylor

*Attorney, Agent, or Firm*—Harness, Dickey & Pierce

[57] ABSTRACT

A foundation element, preferably for subsea use. The element consists of a number of open-bottom cells which are closed at their top and which are delimited by cell walls and comprise a common roof. The element is arranged to penetrate down into the sea bottom soil until the cells are filled with soil. The width of the element corresponds to or is in excess of the length of the cell walls.

The roof of the foundation element, when said element is installed in the bottom strata, is essentially level with the sea bottom surface, thus constituting a high-quality seabed floor suitable for various loads.

The invention also comprises the use of the element for various applications.

9 Claims, 11 Drawing Figures

SUBSEA FOUNDATION ELEMENT AND APPLICATIONS THEREOF

BACKGROUND OF THE INVENTION

The invention concerns a multi-purpose subsea foundation element. Basically, the foundation element consists of a roof and a system of walls defining a number of cells. The roof is flat or slightly domed over each cell. The foundation element includes evacuation means for removal of the water entrapped in the cells and it is intended to be placed at the bottom of the sea with the walls completely penetrating down into the sea bed strata in such a manner that the roof of the element is essentially level with the mudline.

The primary applications of the foundation element are:

- as an anchoring member in which application the element takes lateral mooring loads, for example from a floating structure/platform, or tension loads, for example from a tension leg platform;
- as pre-installed subsea bases in which application the element serves as a base element to which subsea installations or fixed above-water structures are mounted.

Prior-art installations for anchoring and subsea foundation purposes are primarily designed for either one or the other of the tasks outlined above. Anchoring devices designed to take lateral loads differ from devices designed to take tension loads. The disadvantages inherent in prior-art installations are considerable as will appear from the following.

Prior-art anchoring devices could be divided into those designed to take lateral loads and those designed to take tension loads. Conventional moored, semi-submersible platforms are representative of the former kind and tension leg platforms of the latter.

As regards lateral loads, prior-art anchoring devices designed for this purpose include self-penetrating marine anchors, single piles, piled anchor templates, gravity anchors and suction piles.

Conventional self-penetrating marine anchors have several shortcomings, especially as concerns safe performance and accessability for inspection. For instance, chains/wires and connections cannot be inspected. In addition, the as-installed position of the anchor in most cases is not determined. The lack of such vital information as the penetration depth of the anchor and the inclination of the anchor make prediction of anchor performance very difficult and uncertain.

When single piles are used in soft sea beds the chain/-wire of the anchor cannot be connected to the upper end of the pile. Instead, it has to be connected at a level below the mudline. As a result, it is impossible to inspect the chains/wire and its connections.

Piled templates, being high-quality anchoring devices for lateral loads and allowing easy inspection of chain/-wires and all connections, are very expensive.

Other types of lateral-anchorage devices are gravity anchors. These anchor structures are placed on the sea bed and the required anchoring function is provided through gravity. Gravity anchors provide high-efficiency anchorage but they are inherently heavy and thus expensive to handle. By using heavy ballast, applied after installation, their weight can be reduced.

Suction piles consist of short, large-diameter single piles which are installed in such a manner that they penetrate into the sea bed strata with the aid of suction.

Anchors of this type are described for example in U.S. Pat. No. 3,469 900, GB PS Nos. 2 097 739 and PS 144 379.

The most important prior-art anchoring devices for tension loads are piled templates and gravity anchor structures. Single piles, including suction piles, are also used to some extent. The pros and cons of the various anchoring methods are essentially the same as those for corresponding installations for lateral loads discussed above. However, in single piles taking tension loads the connection point is situated at the top end of the pile, which makes it easy to inspect the connection members and the wires.

Subsea installations, such as drilling templates, are normally piled. This is especially the case in soft sea bed strata. In harder foundation soil shallow surface foundations are sometimes used. The use of piled templates is very expensive, particularly on deep-water sites.

An alternative solution for housing wellhead equipment is proposed in GB No. 2 133 060A. This patent specification teaches the installation of the wellhead equipment inside a subsea silo/caisson for protection. One or several suction piles mounted in a cluster, are positioned so as to penetrate into the subsea soil. The soil inside the suction pile is removed. Temporary and-/or permanent floors and roofs are mounted inside the pile body and the wellhead equipment is housed entirely inside the structure thus formed.

As regards the foundation of fixed structures they can be categorized into pile foundations and gravity base foundations. Piling is by far the most common solution.

Piling of offshore structures is a well-proven and cost-effective technique for foundation of fixed structures. However, with increasing depths and platform sizes the piling-related costs tend to become excessive.

Gravity base structures which are pre-fabricated near-shore, are used extensively only in the North Sea. One reason for this geographic limitation is the lack of suitable deep-water near-shore sites in most other parts of the world. Various patented types of gravity base structures exist today. In gravity base structures, which are completely pre-fabricated before installation, the foundation is an integral part of the structure as such. Of special interest in this respect are the structures shown in NO B No. 135 909 (U.S. Pat. No. 3,961,489) and U.S. Pat. No. 3,911,697. These publications describe caisson-type gravity base structures which are equipped with very long skirts forming the foundation.

Other types of fixed above-water structures include articulated columns, guyed towers etc. The foundation of these structures could on the whole be subdivided into the same categories, i.e. piled foundations and gravity foundations. The guyed tower also include lateral load anchors for the mooring lines.

SUMMARY OF THE INVENTION

The purpose of the present invention is to provide a subsea foundation element which can be used for various purposes and applications, such as anchorage and as pre-installed bases. The subsea foundation element in accordance with the invention provides safer and/or less expensive anchoring/foundation systems. The foundation element is of limited dimensions and therefore it is intended to be handled with reasonably small offshore equipment. The subsea foundation element in accordance with the invention is only a fraction of the size of conventional gravity base structures used in the North Sea.

The foundation element in accordance with the invention is characterized therein that it consists of a roof and walls defining a number of open bottom cells, that the cells are arranged, when being evacuated, to penetrate down into the sea bed and be embedded therein at a level wherein the roof is substantially level with the mudline so that the element will form a foundation unit/floor in the sea bed, in that for its intended function the element has width which corresponds to or is in excess of the length of the cell walls, the roof of the foundation element, when said element is embedded in the bottom, constituting a floor accessible for work, connection and installation of equipment, and the like.

Further characteristics of the foundation element and its applications will appear from the subsequent description and the dependent and parallel claims attached hereto.

The foundation element in accordance with the invention can also be used for other types of below and above water structures as well as for onshore structures, as will appear from the following description.

BRIEF DESCRIPTION OF THE DRAWINGS

The invention will be described in closer detail in the following with reference to the accompanying drawings, wherein.

FIGS. *5a* and *5b* are respectively a schematic lateral view and a plan view of the element in accordance with the invention when used as a foundation element for a template.

DETAILED DESCRIPIION OF THE INVENTION

Figure 1:
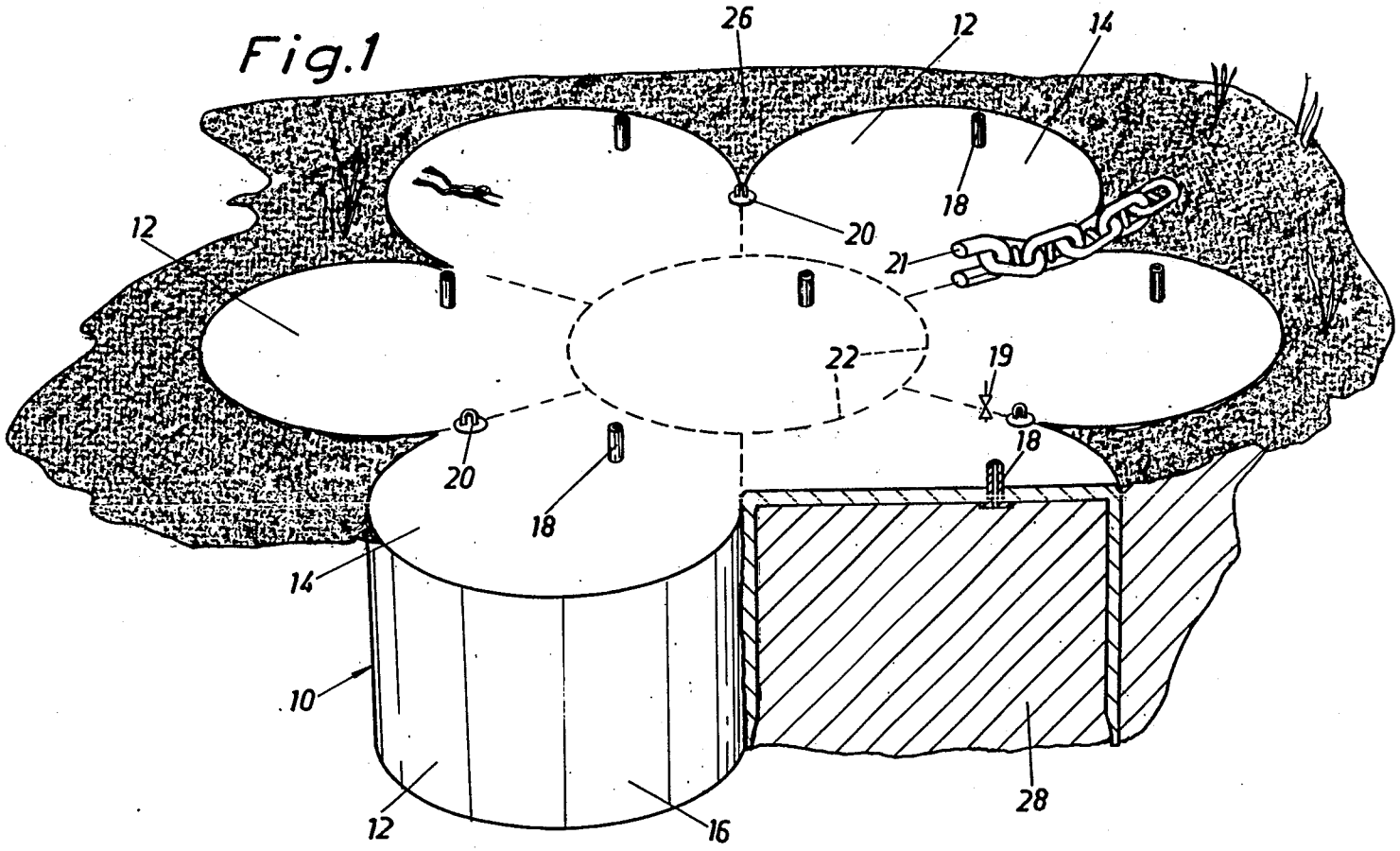
FIG. 1 is a perspective view of one embodiment of the foundation element in accordance with the invention in position having penetrated into the sea bed strata, one of the cells of the element being shown in a cross-sectional view to illustrate the appearance of the cells, FIGS. *2a–2d* are schematic plan views on a reduced scale and show different embodiments of the element in accordance with the invention.

The embodiment of the foundation element 10 in accordance with the invention shown in FIG. 1 consists of seven open-bottom cells 12 which have a common lid or roof 14. Each cell 12 is delimited by a cylindrical cell wall 16. The roof 14 may be flat or slightly dome-shaped across the discrete cells. The cells 12 are equipped with their individual outlet 18 positioned at the roof 14. Via a valve 19 the outlet 18 is connected to a pump (not shown) for evacuation of water from the cells 12. The pump system preferably is reversible, allowing water to be pumped into the cells 12 to disengage the element from the bottom strata. A number of lifting hooks 20 may be provided to handle the foundation element 10. A hook 21 is provided for connection of a lateral lead (cf. FIG. 3).

In the areas 22 where the cells 12 forming the foundation element 10 are tangent to each other they have common walls. In the embodiment shown, the foundation element 10 is manufactured in concrete. The cell walls 16 thusform a continous outer wall in the foundation element 10. Certain parts of the cell walls 16 will not, however, form part of the outer wall but form internal walls.

The foundation element 10 in accordance with the invention is transported to the desired location where it is lowered to the bottom, for instance with the aid of a winch. The foundation element 10 may be made self-floating.

When the element 10 reaches the bottom 26 it sinks by its own weight over a certain distance down into the sea bed soil depending on seabed stiffness conditions. The water enclosed in the cells 12 is then evacuated. Normally this is effected with the aid of the pump-/pumps and in the pumping operation a vacuum pressure is created inside the cells 12. The element 10 penetrate into the bottom 26 until it reaches the position illustrated in FIG. 1 in which the cell walls 16 are completely sunk into the subsea soil. When the element 10 has penetrated fully down into the subsea soil, the roof 14 will be positioned essentially level with the sea bottom 26. In this position the drainage outlets 18 are closed and the soil 28 enclosed inside the foundation element 10 will actually serve and function as part of the element 10. When the element serves as a foundation element it will have an effective weight corresponding to the total weight of both its own weight and the weight of the enclosed soil 28. Consequently, the functional mass of the element is multiplied.

The foundation element 10 in accordance with the invention has a width which corresponds to or exceeds its height. The height of the element 10 corresponds to the depth of penetration of the walls 16 into the bottom strata 26.

In the embedded position the foundation element constitutes a high-quality sea bed floor or base which is capable of taking high loads, lateral as well as vertical (compression and tension) and to a minor degree overturning moments. It is also a perfect base for subsea installations.

The function of the inner walls is to prevent undesired rotational movements of the element 10. Otherwise, when under load, the element would tend to dig into the bottom sea bed at one of its sides (the loaded one) whereas the other side (unloaded) would move upwards from the sea bed.

Figure 2:
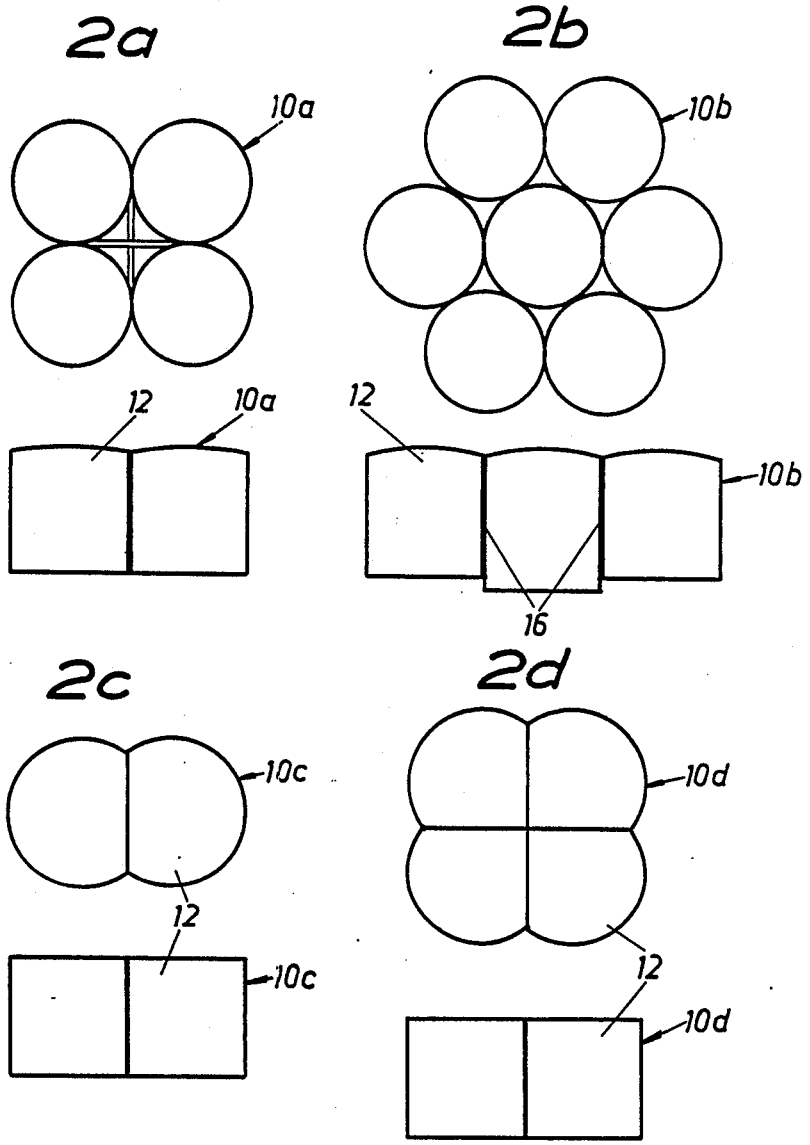

In order to facilitate the penetration of the foundation element 10 into the sea bed soil under certain bottom conditions one or several of the wells 16 - and preferably the central wall 16 in the element 10*b* of FIG. *2b* is chosen for this purpose - may be made somewhat longer than the rest of the walls to ensure that they project and penetrate into the sea bed 26 before the rest of the walls. By emptying the longer cell or cells 12 the initial penetration ability of the element could be considerably improved (cf. FIG. 2). The cell walls 16 could also be made with reduced thickness at their lower ends to further improve the penetration ability of the element into the bottom 26. Another possible measure to facilitate penetration is the application of mechanic or electro-osmotic lubrication on the walls 16. FIGS. *2a–2d* shows the outline configuration of some further possible embodiments of the foundation element in accordance with the invention.

As appears from FIGS. *2a–2d* the configuration of the cells 12 of the foundation element may be chosen comparatively freely and be adapted to requirements determined by function, sea bed conditions, and so on.

The proposed foundation element is primarily intended for soft sea bed conditions, such as normally consolidated clay sites. Other seabed conditions are also possible.

The foundation element, when installed with its roof located essentially level with the mudline, provides a high-quality floor/base for foundation uses. In the following some applications will be described including a few practical examples.

Figure 3:
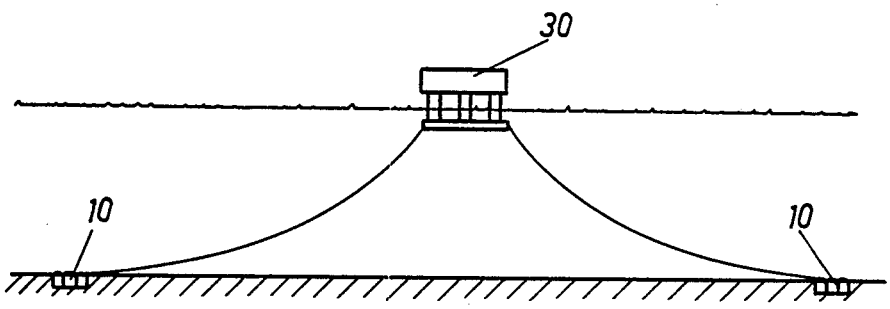
FIGS. 3 and 4 are schematic views of the foundation element in accordance with the invention when used as an anchor to take lateral as well as vertical tension loads.

The foundation element, when installed, is able to resist considerable lateral loads. The foundation element is designed to ensure that neither sliding nor rotary movement occur when the element is exposed to lateral loads. FIG. 3 shows a semi-submersible platform 30 which is anchored with the aid of the foundation element in acccordance with the invention. Typical lateral loads exerted from a moored floating platform are in the range 5 to 7 MN. To safely counter-act loads of this magnitude in soft/clay sites the element should comprise a seven-cell structure as shown in FIG. 1 with a height in the order of 8–10 m and a roof area of some 300 $m^2$. A structure made in concrete would require a volume of concrete of about 300–400 $m^3$, whereas if steel were used, the weight would be some 200–300 t.

Figure 4:
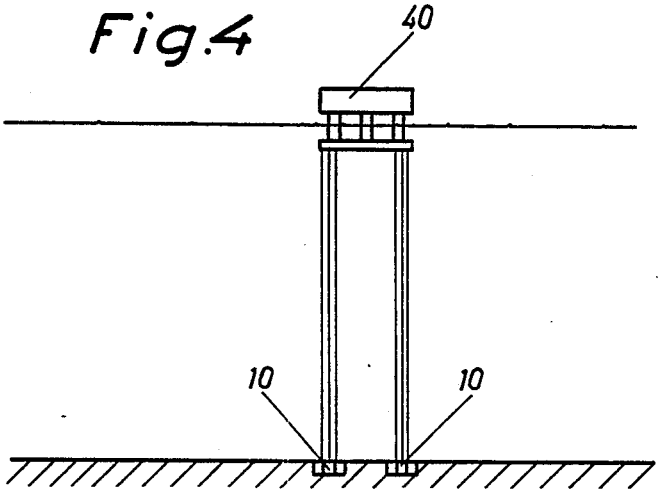

The foundation element in accordance with the invention, when installed, is also able to withstand high-tension loads (vertical loads). This makes the element highly suitable as an anchoring structure for e.g. tension leg platforms 40, see FIG. 4. Four foundation elements 10 installed beneath the corners of the tension leg platform 40 is one suitable anchoring solution. The static tension load exerted on the anchoring point by the tension leg platform 40 is in principle counteracted by the submerged weight of the foundation element 10, including the soil 28 which is confined inside the element 10, and the lateral shear exerted on the periphery of the element 10. The cyclic load component is in principle counteracted by suction (reduction of water pressure) in the foundation soil. The arrangement provides a highly efficient anchorage for installations subjected to tension loads.

Figure 5A:
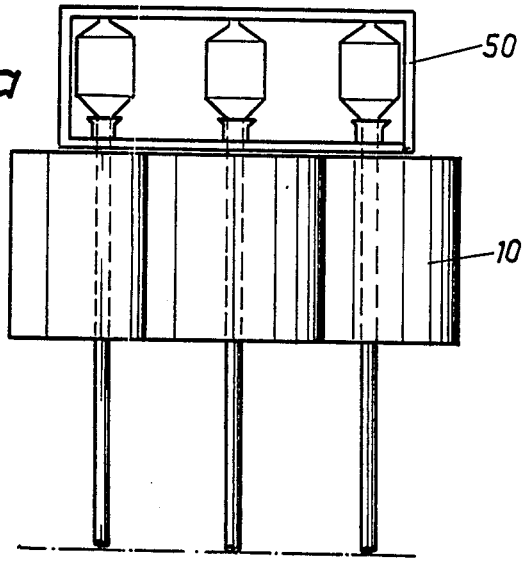
Figure 5B:
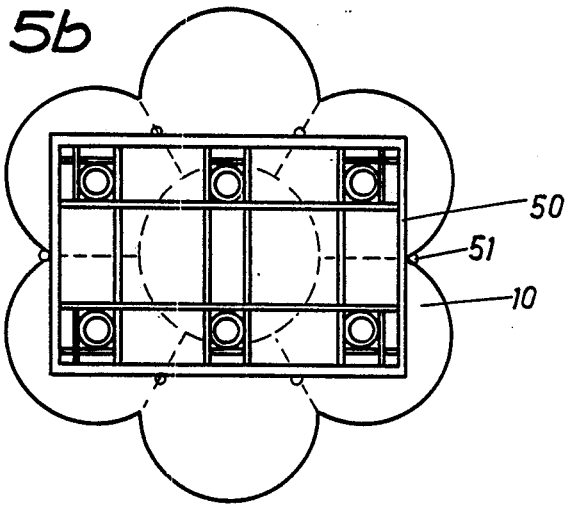

The roof of the foundation element, when installed, provides a perfect base or floor for subsea installations. Subsea installations, for example template-type structures, are easily connected to the element with the aid of prepared joints/connections 51. One example of a subsea template 50 fixed to a pre-installed foundation element 10 is shown in FIGS. 5*a* and 5*b*.

Figure 6:
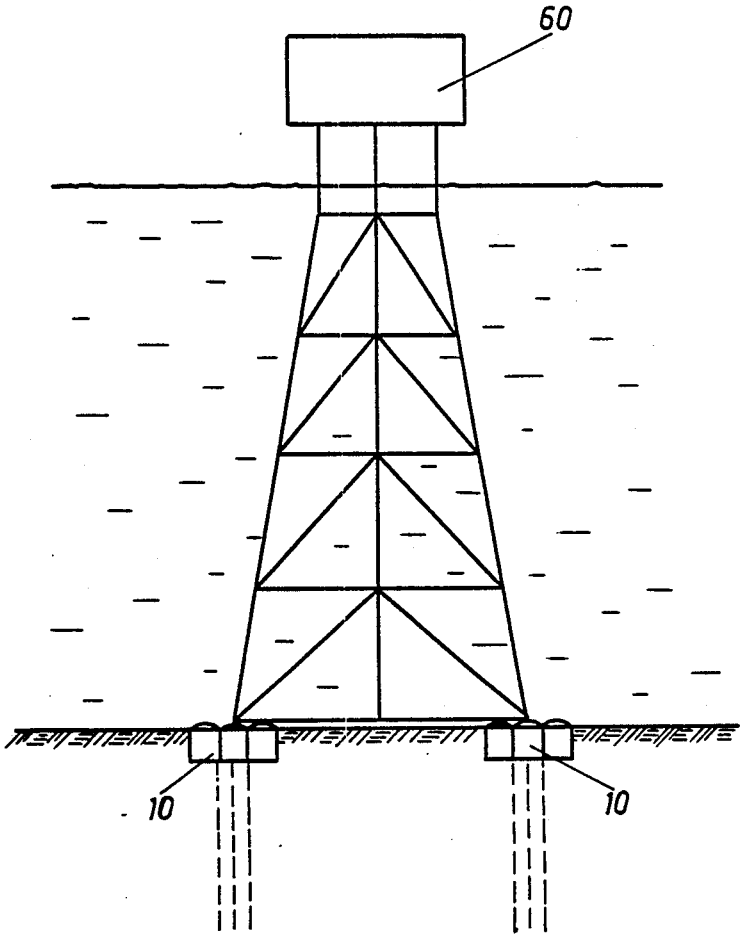
FIGS. 6 and 7 are schematic views of the foundation element in accordance with the invention and show the element used as a foundation for a fixed above-water structure.
Figure 7:
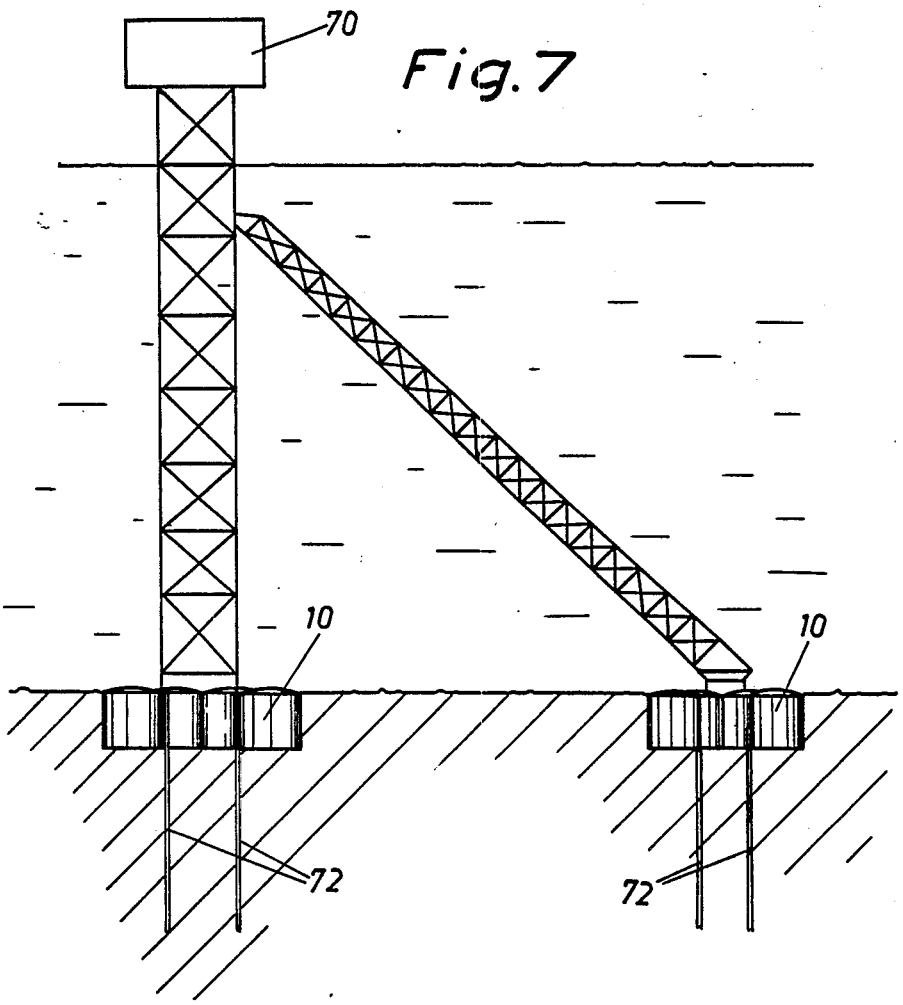

Pre-installed foundation elements 10 can also be used as a foundation for fixed above-water structures 60, 70 to replace piling. Examples of applications of this kind are shown in FIGS. 6 and 7. With multiple foundation elements 10 the load acting on the elements are primarily vertical and lateral with only small local overturning moments. As discussed in the aforegoing the foundation elements 10 are very efficient in counteracting lateral loads and tension loads. Static vertical loads are also efficiently counteracted. However, to avoid settlement the foundation elements 10 may have to be supplemented with piling. The piles (72 in FIG. 7) may be installed hydraulically, using the foundation element as a counteracting means.

Small above-water fixed structures and structures for calm waters may be fixed to a single foundation element 10 in the same manner as subsea templates 50. This is another possible alternative embodiment of the foundation element 10 in accordance with the invention.

The embodiments of the invention described in the aforegoing are to be regarded as examples only and a variety of different embodiments are possible within the scope of the appended claims. It is possible to use the foundation element 10 also as a foundation means onshore for various types of constructions.

What I claim is:

1. An improved anchor element, preferably for subsea use, comprising means for evacuation of the water entrapped inside said element to allow said anchor element to penetrate into and be embedded in the sea bottom strata, the improvement comprising said element consisting of a plurality of open bottom cells each comprising an upper surface and a surrounding dependent wall, said cells being affixed to each other with said walls forming a continuous outer wall for said element and said upper surfaces defining a roof, said cells having means for evacuating said cells to penetrate down into the sea bed and be embedded therein at a level wherein said roof is substantially level with the mudline so that the element will form an anchor unit/floor in said sea bed with said roof providing an area for work, connection and installation of equipment, and the like, said roof having a width at least equal to the length of said cell walls.

2. An improved anchor element as claimed in claim 1, wherein said cell wall of at least one of said cells is prolonged relative to another of said cell walls to facilitate the initial penetration of said anchor element into the bottom/sea bed.

3. An improved anchor element as claimed in claim 1, comprising said roof forming an essentially flat surface which will be level with the sea bottom when said anchor element is embedded in the sea bed.

4. An improved anchor element as claimed in claim 1, comprising said anchor element consisting of concrete.

5. An improved anchor element as claimed in claim 1, comprising said anchor element being of steel.

6. The use of said anchor element in accordance with claim 1 for subsea application, said element comprising means for evacuation of water entrapped inside the element so as to enable said element to penetrate into and be embedded in the sea bed, the improvement comprising said anchor element serving as a foundation for anchoring of a structure attached thereto.

7. The use of the anchor element according to claim 6, comprising subsea installations attached to said element.

8. The use of the anchor element according to claim 6, comprising a platform floating at sea level, said platform being anchored to said element.

9. The use of the anchor element according to claim 6, comprising said anchor element used as a base to support an above-water structure.

* * * * *